US005938318A

United States Patent [19]

Mattsen

[11] Patent Number: 5,938,318

[45] Date of Patent: Aug. 17, 1999

[54] NOVELTY SHADOW PROJECTION LAMP

[76] Inventor: Gregory Paul Mattsen, 253 N. Clark St., Powell, Wyo. 82435

[21] Appl. No.: 08/918,580

[22] Filed: Aug. 19, 1997

[51] Int. Cl.[6] ..... F21V 5/00

[52] U.S. Cl. ..... 362/318; 362/101; 362/806; 362/811; 40/409

[58] Field of Search ..... 362/318, 101, 362/96, 40, 811, 806; 40/406, 409, 560

[56] References Cited

U.S. PATENT DOCUMENTS

| | | | |
|---|---|---|---|
| D. 292,615 | 11/1987 | Tolson, Sr. | D26/4 |
| 3,387,396 | 6/1968 | Smith | 40/406 |
| 3,570,156 | 3/1971 | Walker | 40/406 |
| 3,666,936 | 5/1972 | Webster, Jr. et al. | 240/2 |
| 4,020,337 | 4/1977 | Chatten | 240/10 |
| 4,065,865 | 1/1978 | Chovan | 40/444 |
| 4,274,129 | 6/1981 | Stevens | 362/109 |
| 4,511,952 | 4/1985 | Vanbragt | 362/181 |
| 5,778,576 | 7/1998 | Kaviani | 40/406 |

*Primary Examiner*—Sandra O'Shea
*Assistant Examiner*—Todd Reed Hopper

[57] ABSTRACT

A novelty shadow projecting lamp is disclosed having at the center a light source contained in a protective enclosure. A portal or opening lets light escape in a predetermined direction, and is in visual communication with and surrounding a light source enveloped by a bi-phased liquid. The bi-phased liquid includes bits of meltable wax. A heat source located in the base portion of the lamp, is in thermal communication with the liquid. As the heating element melts the wax, which is suspended in the liquid, the wax melts and floats freely in the liquid, thereby passing through the light source and casting shadows onto walls and surrounding area.

8 Claims, 4 Drawing Sheets

NOVELTY SHADOW PROJECTION LAMP

BACKGROUND OF THE INVENTION

1. Field of the Invention

The present invention relates generally to lamps and lighting devices and, more particularly, to a novelty lamp designed to produce and project shadows throughout the immediate surrounding area.

2. Description of the Related Art

As is well known in the related art, many lamps and lighting devices are known. Although most are for either general or specific illumination, others are known for specialty or novelty purposes. A search of the prior art did not disclose any references related to specialty or novelty lamps that read directly on the claims of the instant invention; however, the following references were considered related:

| U.S. Pat. No. | Inventor | Issue Date |
|---|---|---|
| 4,511,952 | Vanbragt | Apr. 16, 1985 |
| 4,274,129 | Stevens | Jun. 16, 1981 |
| 4,065,865 | Chovan | Jan. 3, 1978 |
| 4,020,337 | Chatten | Apr. 26, 1977 |
| 3,666,936 | Webster, Jr. et al. | May 30, 1972 |
| D 292,615 | Tolson, Sr. | Nov. 3, 1987 |

Of considerable relevance are U.S. Pat. No. 3,666,936 and U.S. Pat. No. Des. 292,615. The '936 reference discloses a shadow box, and the '615 reference discloses a novelty incandescent lamp apparently capable of projecting a novelty shadow. These features incorporated into the present invention in combination with other elements as disclosed below or known from "lava-lamp" type products are different enough as to make the combination distinguished over these and other art. Consequently, a need has been felt for a novelty lamp designed to produce and project shadows throughout the immediate surrounding area.

SUMMARY OF THE INVENTION

It is therefore an object of the present invention to provide an improved novelty lamp.

It is a feature of the present invention to provide an improved novelty lamp designed to produce and project shadows throughout the immediate surrounding area.

Briefly described according to one embodiment of the present invention, a novelty shadow projecting lamp is disclosed having at the center a light source contained in a protective enclosure. In its preferred embodiment, in visual communication with, and preferably surrounding the light source, is a bi-phased liquid. The bi-phased liquid includes bits of meltable wax. A heat source is located in the base portion of the lamp, in thermal communication with the liquid.

The advantage of the present invention is that once activated, the heating element melts the wax suspended in the liquid. As the wax melts, it floats freely in the liquid. A fluctuation in densities between the two liquids drives a continuous circulation within the lamp. As the wax passes through the light source, shadows are cast onto walls and other items.

Further variations are shape, color, fluid type, and dimension. These can result in a variety of shadows produced and projected throughout the surrounding area.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
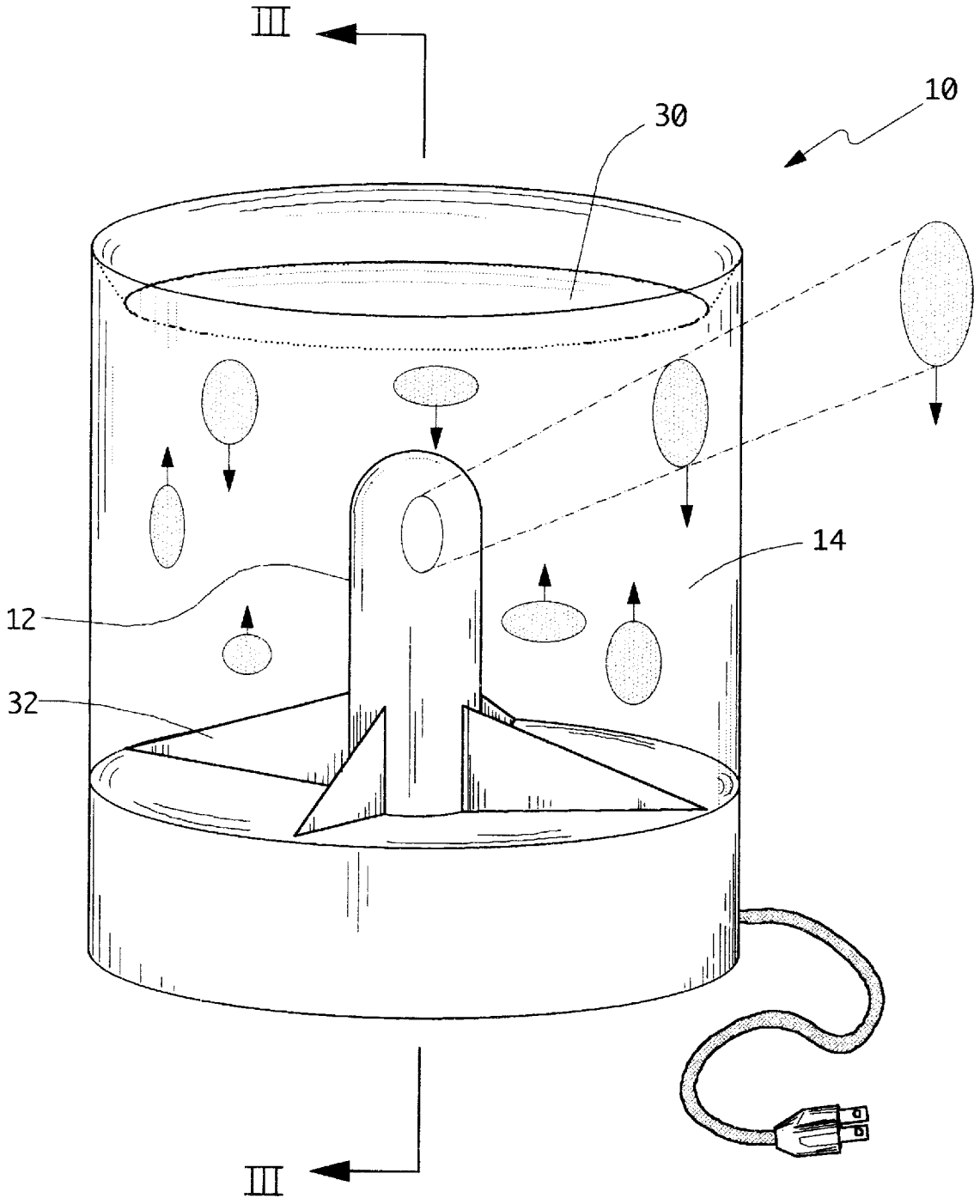
FIG. 1 is a perspective view of a novelty lamp according to the preferred embodiment of the present invention.
Figure 2:
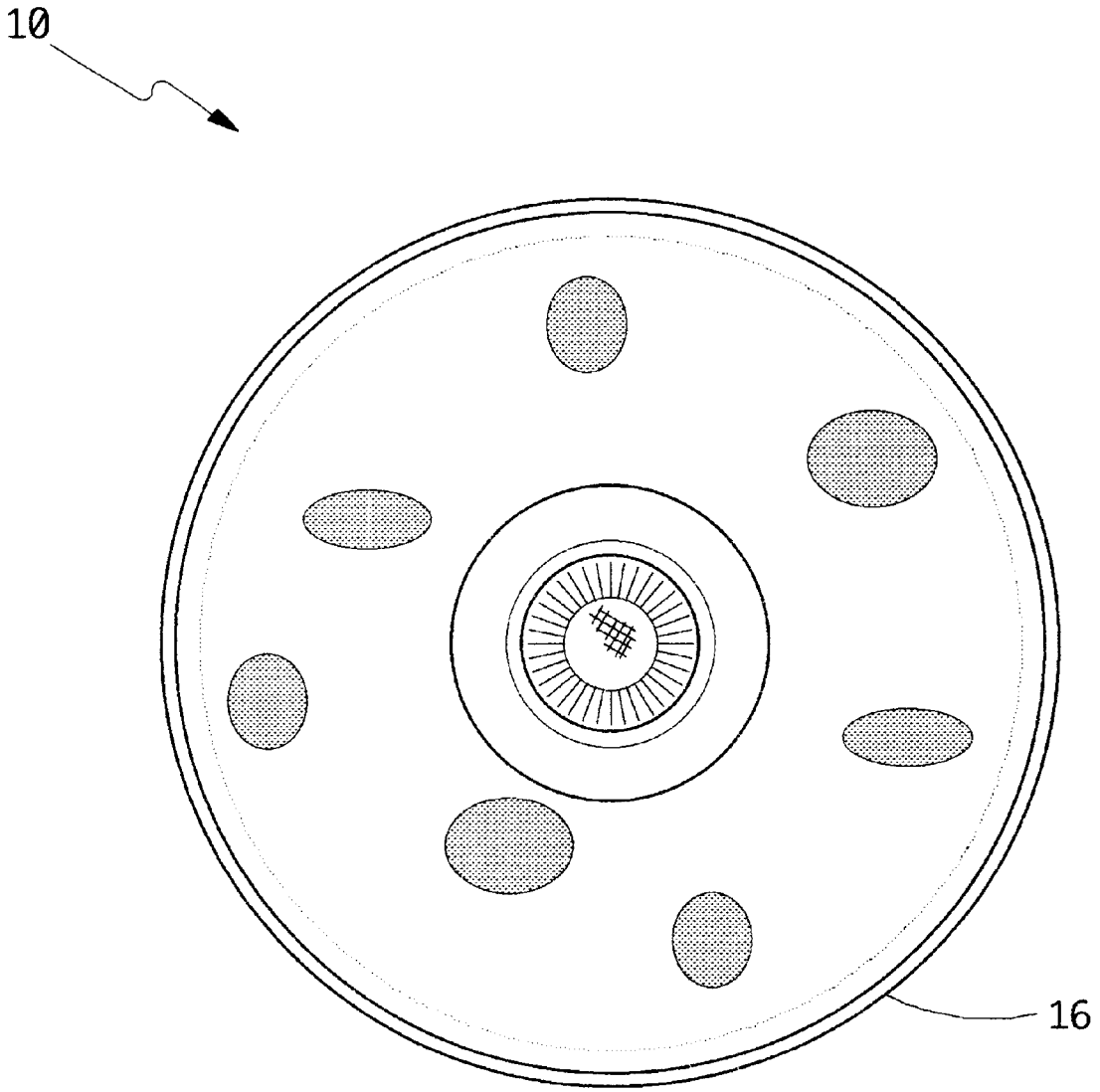
FIG. 2 is a top plan view thereof taken along the cross section indicated by line II—II of FIG. 1.
Figure 3:
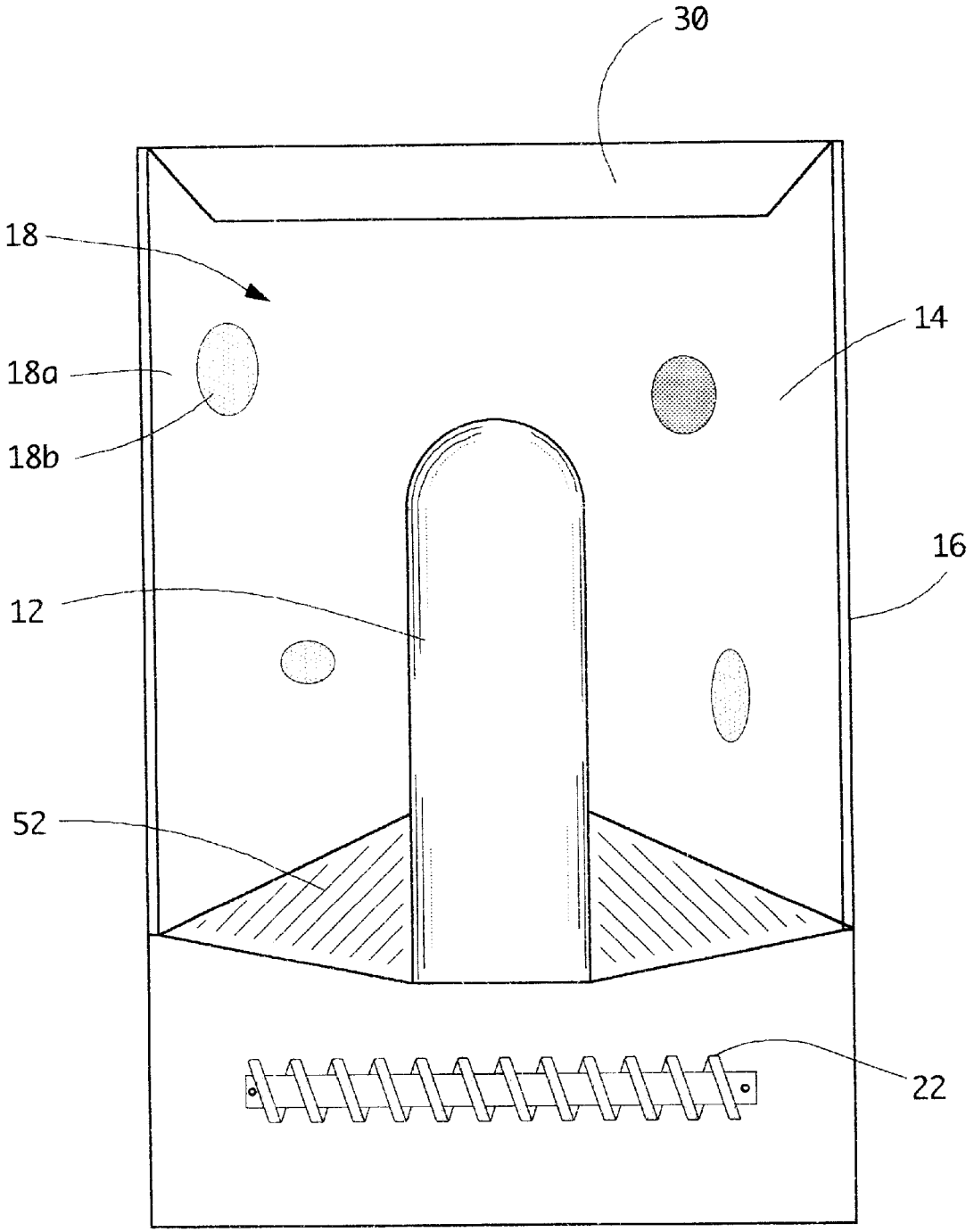
FIG. 3 is a side elevational view of the present invention taken along the cross section indicated by line III—III of FIG. 1.

Referring now to FIG. 1–4, a novelty shadow projecting lamp (lamp) 10 is shown, according to the present invention, herein depicted in a cylindrical configuration. Although the lamp's actual construction can accommodate a variety of sizes and shapes, by way of example and not by limitation, a cylindrical configuration will be shown and described herein for illustration purposes only. It is envisioned that actual size, shape, and dimensions can be adaptable to a variety of manufacturing and marketing concerns while still remaining within the teachings of the present disclosure. Upon this basis, the lamp 10 is shown and depicted having an outwardly directed illumination source 12 mounted within the interior space (as shown in the center) of a fluid containment vessel 14. It is envisioned that the outward direction of the illumination source will offer a large degree of general illumination. The illumination source is shown as an incandescent lamp housed within a protective cylinder or tube capable of separating the lamp from the fluid 18. However, it is also envisioned that other types of lamps, such as fluorescent or halogen, can be mounted in direct physical contact with the fluid 18. Unlike with traditional "lava-lamps", the illumination source of the present invention functions solely as illumination, and is directed to illuminate the surroundings, and is not functioning as either a primary or alternate heat source. As shown, the fluid containment vessel 14 is depicted as a cylindrical container for holding a fluid suspension 18, and further having a transparent outer wall 16 through which light from the illumination source 12 can easily pass. In the annular space formed between the illumination source 12 and the outer wall 16, an otherwise freely flowing fluid suspension 18 is contained. Although other combinations are envisioned, in its embodiment, the fluid suspension 18 is comprised of two immiscible liquids having differing densities at room temperature. A first liquid 18*a,* having a transparent character and a lighter density, fills the free space of the containment vessel 14. It is envisioned that this first liquid 18*a* would comprise oil, glycerine, or the like. A second liquid 18*b,* having an opaque or translucent character and a greater density, is dispersed in a smaller quantity throughout the first liquid 18*a*. It is felt that a wax would preferably comprise this second liquid 18*b*. A heat generation means 22 located in the base portion 24 of the lamp 10 and in thermal communication with the liquid 18. As such, the oil and wax inside the fluid containment vessel 14 will begin to rise at different rates when heat is applied along the lower surface of the fluid containment vessel 14. This heat generation means 22 creates a thermal flux in the fluid 18. It is envisioned that a metal coil in the bottom of the main chamber can be used to conduct heat into the fluid 18. Thus, the wax 18*b* expands more rapidly than the oil 18*a* and becomes less dense and begins to rise and circulate. As the wax 18*b* rises away from the heat generation means 22, it cools, densifies, and sinks to the bottom of the oil 18*a* into a semi-solid mass. This fluctuation in densities drives a continuous circulation.

Once activated, the heating element 22 melts the wax 18*b* which is suspended in the liquid 18*a*. As the wax melts, it floats freely in the liquid, and as the wax passes through the light source 12, shadows are cast onto walls and other items.

Two features are envisioned along the internal structure of the lamp 10 designed to direct and control the motion of fluid currents during operation. An outwardly sloping, conical top 30 penetrates within the internal fluid space of the lamp in order to guide wax away from the center of the lamp. By guiding the opaque material 18*b* to the exterior surface of the lamp and away from the center, the lamp 10 creates sharper, sharper, more distinct shadows are cast as the opaque material passes in front of the illumination source. Also, it is envisioned that upwardly directed protuberances 32, envisioned as radially oriented, ramp shaped ridges or spikes, are affixed to or formed along the bottom surface of the interior fluid space. These function as a flow director and splitter for downwardly moving wax. This functions to keep the wax dispersed evenly throughout the lamp, and to split coagulated wax that is cooling.

Figure 4:
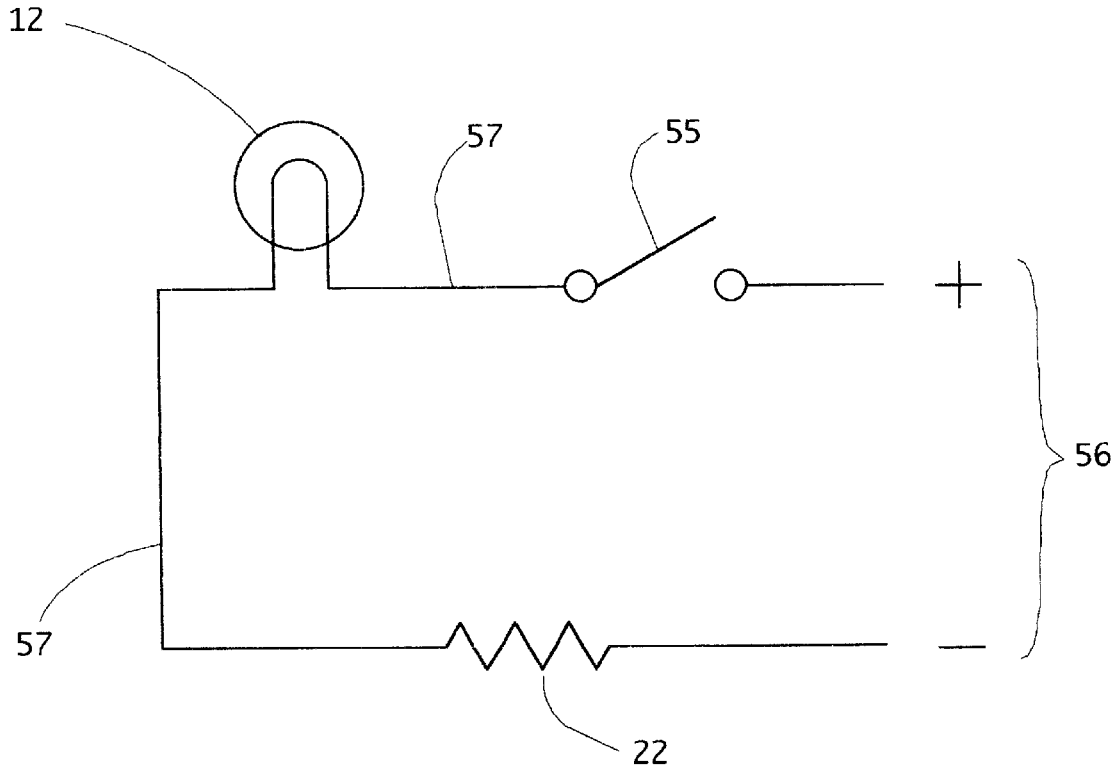
FIG. 4 is an electrical schematic for use with the novelty lamp of the present invention.

Referring finally to FIG. 4, an electrical schematic diagram depicting the controlling circuitry of the novelty shadow projecting lamp 10 is disclosed. The illumination source 12 is herein depicted as a inductance source such as an incandescent lamp, although other illumination means such as fluorescent or halogen lamps would also provide sufficient functionality. The heat element 22 is indicated as a resistance coil for heat generation, and an on/off switch 55 is shown in communication between the power cord 56 and the conductors 57 forming the remainder of the electric circuit.

2. Operation of the Preferred Embodiment

Once the present invention is activated, the heating means melts the wax which is suspended in the liquid. As the wax melts, it floats freely in the liquid, and as the opaque wax 18*b* passes through the light source, shadows are cast onto walls and other items.

The foregoing description is included to illustrate the operation of the preferred embodiment and is not meant to limit the scope of the invention. Based upon the present disclosure, it is felt that one skilled in the art could practice a variety of devices within the scope of this invention. By way of illustration and not limitation, variations such as assorted color combinations of illumination means and opaque wax, or colored or opaque glass containers could be provided in order to produce and project shadows throughout the immediately surrounding area in a manner to elicit various moods, ambiance, or atmosphere. Further, other opaque or translucent shadow generation means can be incorporated, such as semi-buoyant solid or hollow-filled floats or balls. As such, the scope of the invention is to be limited only by the following claims.

What is claimed is:

1. A shadow projecting lamp comprising:

a fluid containment vessel forming an interior space at its center and having an outer wall;

an outwardly directed illumination source mounted within the interior space of a fluid containment vessel;

an annular space formed between the illumination source and the outer wall; and a fluid suspension comprised of two immiscible liquids having differing densities at room temperature, said fluid suspension held within said annular space, and an outwardly sloping, conical top penetrating within the internal fluid space of the lamp in order to guide wax away from the center of the lamp.

2. The shadow projecting lamp of claim 1, wherein said illumination source comprises an incandescent lamp housed within a protective cylinder or tube capable of separating the lamp from the fluid.

3. The shadow projecting lamp of claim 1, wherein said fluid containment vessel is formed as a cylindrical container for holding a fluid suspension, and further includes a transparent outer wall through which light from the illumination source can easily pass.

4. The shadow projecting lamp of claim 3, wherein said fluid suspension includes:

a first liquid having a transparent character and a lighter density, said first liquid filling the free space of the containment vessel;

a second liquid having an opaque or translucent character and a greater density, said second liquid being dispersed in a smaller quantity throughout the first liquid; and a heat generation means located in the base portion of the lamp and in thermal communication with said liquids.

5. The shadow projecting lamp of claim 4, wherein said first liquid comprises oil.

6. The novelty shadow projecting lamp of claim 4, wherein said first liquid comprises glycerine.

7. The novelty shadow projecting lamp of claim 4, wherein said second liquid comprises wax.

8. The shadow projecting lamp of claim 7, further comprising radially oriented, ramp shaped ridges or spikes affixed to or formed along the bottom surface of the interior fluid space for functioning as a flow director and splitter for downwardly moving wax.

* * * * *